US009921031B2

(12) United States Patent
Badr

(10) Patent No.: US 9,921,031 B2
(45) Date of Patent: Mar. 20, 2018

(54) FIREARM HOLSTER FACILITATING RAPID MAGAZINE REPLACEMENT

(71) Applicant: Omar-Samir M. Badr, Pooler, GA (US)

(72) Inventor: Omar-Samir M. Badr, Pooler, GA (US)

( * ) Notice: Subject to any disclaimer, the term of this patent is extended or adjusted under 35 U.S.C. 154(b) by 14 days.

(21) Appl. No.: 15/239,282

(22) Filed: Aug. 17, 2016

(65) Prior Publication Data

US 2018/0051960 A1 Feb. 22, 2018

(51) Int. Cl.

| | |
|---|---|
| ***F41C 33/04*** | (2006.01) |
| ***F42B 39/26*** | (2006.01) |
| ***F41C 33/02*** | (2006.01) |
| ***F42B 39/02*** | (2006.01) |

(52) U.S. Cl.

CPC ..... *F41C 33/0281* (2013.01); *F41C 33/0236* (2013.01); *F41C 33/04* (2013.01); *F42B 39/02* (2013.01); *A45F 2200/0591* (2013.01); *F42B 39/26* (2013.01)

(58) Field of Classification Search

CPC ... A45F 2200/0591; F42B 39/26; F41C 33/04
USPC ..... 224/912, 931; D3/222, 262
See application file for complete search history.

(56) References Cited

U.S. PATENT DOCUMENTS 3,938,717 A * 2/1976 Theodore ..... F41A 9/63 206/350
4,408,706 A * 10/1983 Hurley ..... B26B 29/025 224/192
4,828,154 A * 5/1989 Clifton, Jr. ..... A45F 5/14 224/192
5,449,103 A * 9/1995 Tilley ..... F41A 17/063 224/244
5,676,241 A * 10/1997 Degoix ..... F42B 39/26 206/3
6,050,464 A 4/2000 Ramsey, Sr. et al.
6,547,118 B2 * 4/2003 Beletsky ..... A45F 5/00 224/661
7,194,837 B2 * 3/2007 Obong ..... F42B 39/02 224/931
7,258,259 B1 * 8/2007 Owens ..... A45F 5/02 224/192
D574,147 S * 8/2008 Zusman ..... D3/222
D594,649 S * 6/2009 Zusman ..... D3/222
D601,339 S * 10/2009 Zusman ..... D3/222
(Continued)

*Primary Examiner* — Justin Larson
(74) *Attorney, Agent, or Firm* — John G. Posa; Belzer P.C.

(57) ABSTRACT

A holster facilitating rapid magazine replacement includes a pistol sleeve and a spare magazine holder including at least one well configured for receiving a spare magazine. The spare magazine is supported at a predetermined angle relative to the grip of the pistol in the pistol sleeve to allow for straightforward exchange. The spare magazine may be substantially parallel or at least near-parallel to the magazine loaded in the grip of the pistol in the pistol sleeve. The holster preferably includes two wells in a vertical stack, each configured to receive a spare magazine at substantially the same angle. One or more fasteners may be provided for adjusting the frictional engagement of the spare magazine disposed in each well. The spare magazine(s) may be disposed in a plane parallel to the plane of the pistol, and this plane may be offset from the plane defined by the grip and the barrel of the gun.

13 Claims, 8 Drawing Sheets

(56) References Cited

U.S. PATENT DOCUMENTS 7,614,534 B2 * 11/2009 Veo ..... G07F 11/16 224/196
7,805,875 B1 * 10/2010 Obong ..... F41A 9/61 224/931
7,866,515 B1 * 1/2011 Buis, III ..... F41C 33/02 224/197
7,950,554 B2 * 5/2011 Hoffner ..... A45F 5/02 224/222
8,104,656 B1 * 1/2012 George ..... A45F 5/021 224/239
8,231,038 B2 * 7/2012 Felts ..... A45F 5/02 224/665
8,251,266 B2 * 8/2012 Gregory ..... F41C 33/045 224/198
8,555,538 B2 10/2013 Huffines
8,646,665 B2 2/2014 Abushaev
8,733,606 B2 * 5/2014 Felts ..... F42B 39/02 224/245
8,887,972 B2 * 11/2014 Solomon ..... A45F 5/02 224/245
D749,843 S * 2/2016 Faifer ..... D3/262
9,459,062 B2 * 10/2016 Shaskan ..... F41A 9/65
9,795,210 B2 * 10/2017 Evans ..... A45F 5/02
2005/0127121 A1 * 6/2005 Wells ..... F41C 33/0209 224/193
2013/0248566 A1 * 9/2013 Solomon ..... A45F 5/02 224/191
2014/0041275 A1 2/2014 Herrington
2015/0369559 A1 * 12/2015 Del Rosario ..... F41C 33/029 340/686.4
2016/0100678 A1 * 4/2016 Evans ..... A45F 5/00 224/231
2016/0209163 A1 * 7/2016 VanHeusen ..... A45F 5/02
2016/0273899 A1 * 9/2016 Rodriguez ..... F42B 39/02
2016/0370137 A1 * 12/2016 Shaskan ..... F41A 9/65
2017/0016696 A1 * 1/2017 Koskan ..... F41C 33/0209
2017/0160051 A1 * 6/2017 Munz ..... F41C 33/0209

* cited by examiner

Loaded View

Explode View

FIREARM HOLSTER FACILITATING RAPID MAGAZINE REPLACEMENT

FIELD OF THE INVENTION

This invention relates generally to pistol holsters and, in particular, to a holster facilitating rapid magazine replacement.

BACKGROUND OF THE INVENTION

The time required to replace a magazine or clip in a firearm can literally mean the difference between life and death. In a shoot-out situation, the shooter who can reload the fastest is probably the one who will prevail.

As such, systems have been developed for faster reloading, including one-handed loading. One example is described in U.S. Pat. No. 6,050,464. The system includes a magazine holder removably connected to a hinge for removably receiving and holding an ammunition magazine for an automatic pistol. A cover strap is attached to the cover for facilitating convenient carrying of the ammunition magazine when the cover strap is fastened in place. Release of the cover strap causes movement of the hinge by the spring to position the magazine in a position for facilitating one-handed loading of the magazine into an automatic pistol by the user. The magazine holder can be connected to the hinge for facilitating use by a right-handed or left-handed user.

In accordance with U.S. Pat. No. 8,555,538, having exhausted the ammunition in the magazine of a firearm, the user ejects the spent magazine from the firearm. While using the hand that is holding the firearm, the user then positions the firearm over the firearm magazine holster in a manner directly in-line with the magazine. Applying downward force, the user moves the firearm downward onto the magazine to displace a shield, such that the user is able to slide the firearm over the magazine until the magazine is received within the firearm. The user then removes the firearm from the firearm magazine holster, chambers the ammunition from the newly inserted magazine into the firearm, and continues their engagement in the conflict.

U.S. Pat. No. 8,646,665 discloses a pistol holster that permits a pistol to be loaded while in the holster. To affect this, the holster body containing the lower portion of a pistol, slides downward relative to a slide bar component that holds the breach block of the pistol, allowing a live round of ammunition to be loaded into the pistol's firing chamber with a single hand action, to make the pistol ready for firing. The holster also contains one or more locks to prevent unintentional removal of the pistol from the holster.

Published U.S. Patent Application No. 2014/0041275 purportedly allows an individual to perform all functions necessary for shooting a semi-automatic pistol with the use of only one hand. It aids the shooter in loading a magazine, replacing an expended magazine, manipulating the slide and, with the ram rod in place, the shooter can clear a barrel obstruction with only one hand. The device provides means for carrying multiple spare magazines as well as the means to load and change magazines in the pistol. With the slide fork and ram rod absent, the platform becomes a magazine speed changer.

While the systems just described in some cases facilitate rapid clip exchange, they have disadvantages

SUMMARY OF THE INVENTION

This invention resides in a holster facilitating rapid magazine replacement for a pistol having a barrel and a magazine-receiving grip disposed at an angle relative to the barrel. The magazine comprises a magazine tube with a floor plate end. A preferred embodiment of the invention comprises a pistol sleeve for receiving the barrel of the pistol and a spare magazine holder. The spare magazine holder includes at least one well configured for receiving the spare magazine such that the floor plate end is exposed for grasping by a user. The spare magazine is supported in the spare magazine holder at a predetermined angle relative to the grip of the pistol in the pistol sleeve to allow for straightforward exchange. I preferred embodiments the predetermined angle is zero to 15 degrees. In the most preferred embodiments the spare magazine is substantially parallel to the magazine in the grip of the pistol in the pistol sleeve. The spare magazine holder also preferably includes a plurality of wells in a vertical stack, each configured to receive a spare magazine at substantially the same angle.

The spare magazine holder may include spaced-apart front and back panels defining each spare magazine well. One or both of the front and back panels may be conformal to the magazine tube(s). Each spare magazine is preferably frictionally disposed within each well. One or more fasteners may be provided for adjusting the spacing between the front and back panels so as to adjust the frictional engagement of the spare magazine disposed in the well. The fasteners may extend through compressible members between the front and back panels to maintain the adjusted spacing. The spare magazine(s) may be disposed in the spare magazine holder in a plane parallel to the plane of the pistol, and this plane may be offset from the plane defined by the grip and the barrel of the gun.

DETAILED DESCRIPTION OF THE INVENTION

Figure 1:
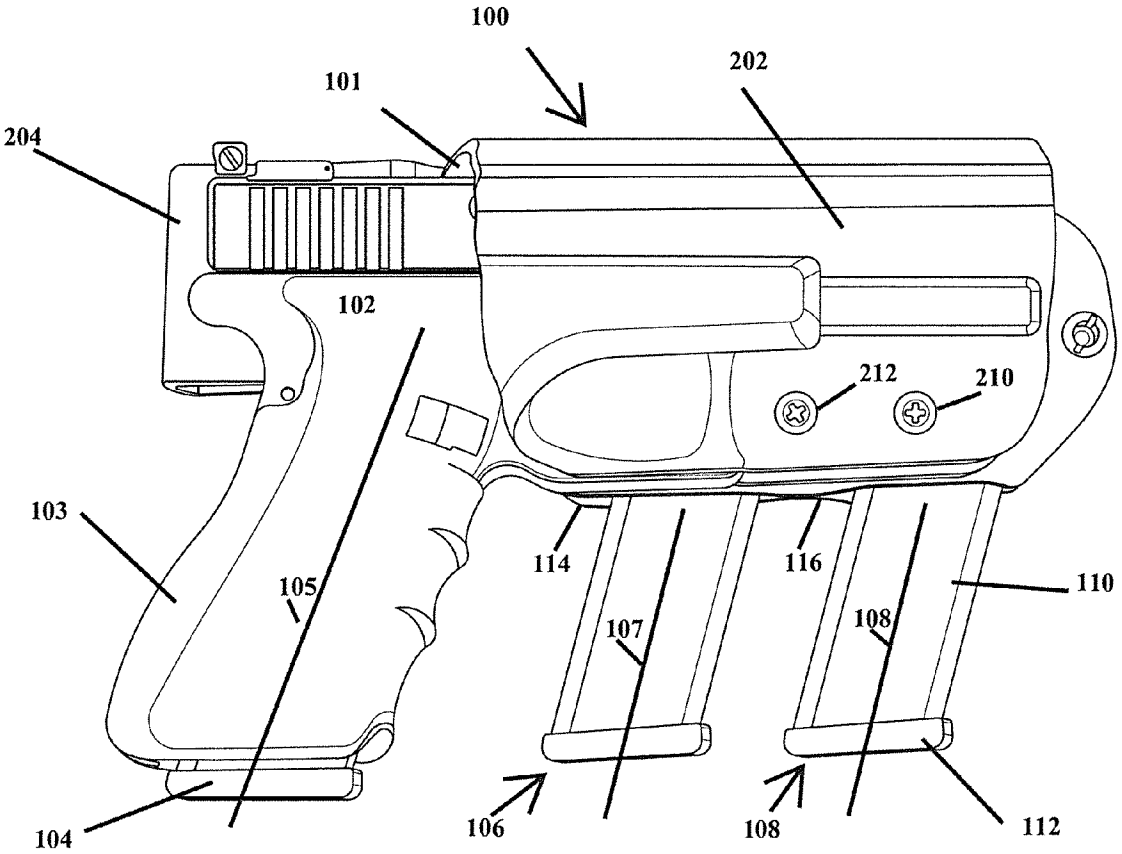
FIG. 1 is a view of a preferred embodiment in a loaded condition.

FIG. 1 is a view of a preferred embodiment of the invention shown generally at 100 in a loaded condition. The article includes a sleeve 101 to receive the barrel of a weapon 102 having a barrel (hidden by the sleeve) and a grip 103. The weapon in this case is a semi-automatic 9 mm Glock pistol, though the invention is not limited with respect to the weapon itself.

The grip 103 of the pistol includes a magazine 104 defining an axis 105. The angle between the magazine in the grip and the barrel is usually in the range of 100 to 120 degrees, more particularly around 110 degrees for the Glock handgun.

The embodiment shown in FIG. 1 includes 2 spare magazines, 106 and 108, disposed in wells 114, 116. The wells are configured to retain the tubes 110 of each magazine in a frictional fit, with the floor plate 112 of the cartridge loading end exposed as shown. In the figure, less than half of each magazine tube is retained in each well. While this was found to be sufficient, up to half the length or more of each magazine tube may be received by each well. Further, although two spare magazine wells are shown in FIG. 1, embodiments of the invention may have a single well or more than two. It has been found that two is a convenient number given the length of the barrel.

In the preferred embodiments, the spare magazines are disposed directly below the grip of the gun, and at an angle comparable to the angle of the magazine already in the clip. In the most preferred embodiments the spare magazines are parallel or near parallel to the loaded magazine; that is, lines 105 and 107 in FIG. 1 are preferably parallel or near-parallel, though divergence of up to 20 degrees or even more is possible though less effective during exchange.

Figure 2:
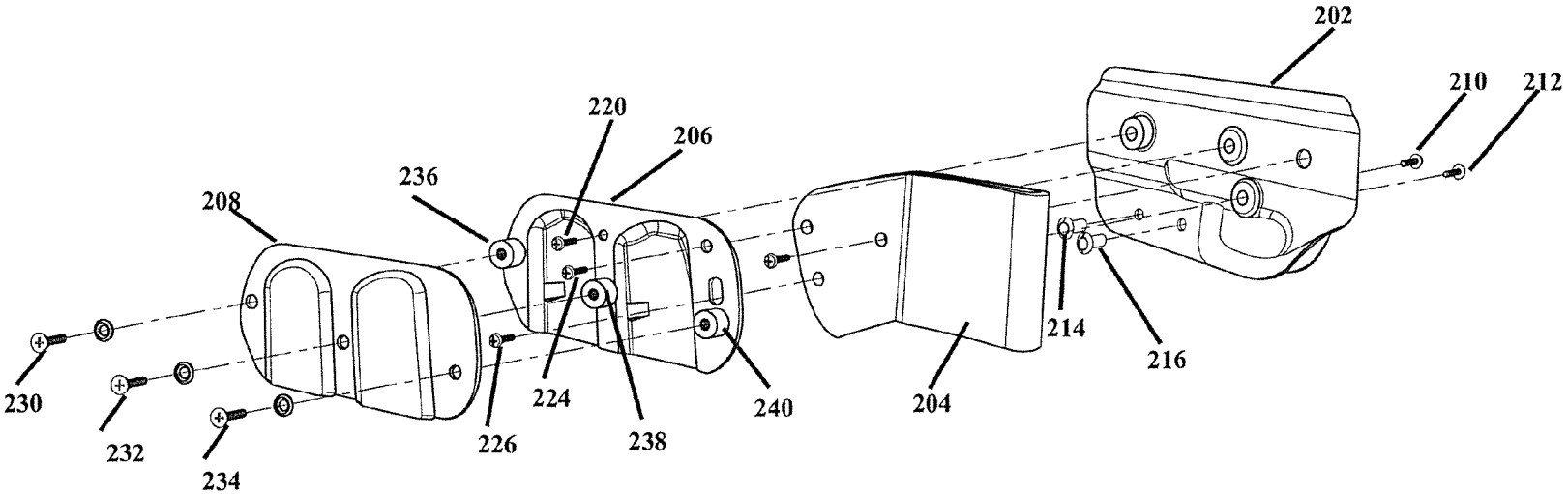
FIG. 2 is an exploded view.

FIG. 2 is an exploded view of a preferred embodiment. In this embodiment, all of these pieces are made from formed rigid or semi-rigid stock such as Kydex®, though other thermoformed materials and even leather may alternatively be used. However, although this version of the invention is made by assembling component parts, it will be appreciated that some or all of the article may be constructed through other processes including plastic injection molding.

The assembly of FIG. 2 includes a pistol sleeve 202, belt tunnel 204, back well panel 206 and front well panel 208. Pistol sleeve 202 is itself a piece of folded material, held together with fasteners 210, 212, 214, 216. Fasteners 220, 224, 226 hold back well panel 206 to sleeve 202, sandwiching belt tunnel 204 in between. Fasteners 230, 232, 234 hold together back and front panels 206, 208, thereby forming the spare magazine wells. The fasteners 230, 232, 234 are received by bushings 235, 238, 240 disposed between the front and back panels. The bushings are made of a compressible/resilient rubber or rubber-like material enabling the spacing between panels 206, 208 to be set and adjusted for a desired frictional fit between the spare magazines and the wells. It has been found that a pull force on the order of 5-12 pounds or thereabouts is suitable for most users.

Figure 3:
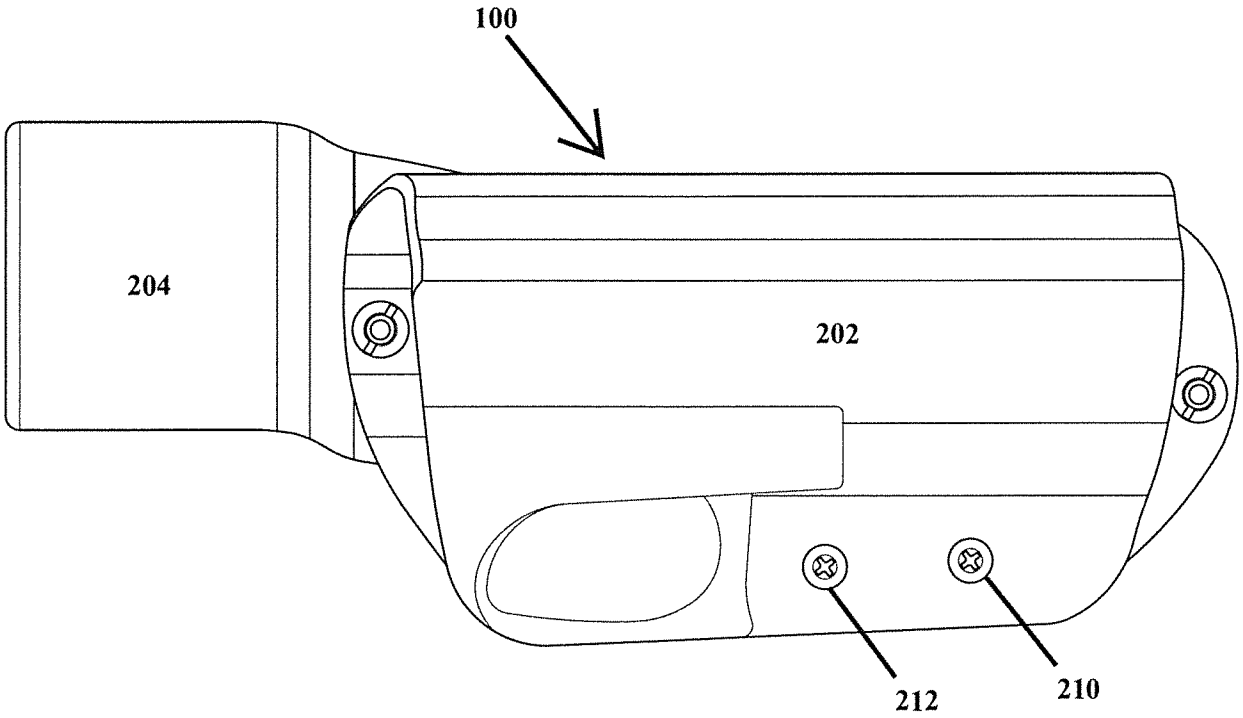
FIG. 3 is a side view in an unloaded state.
Figure 4:
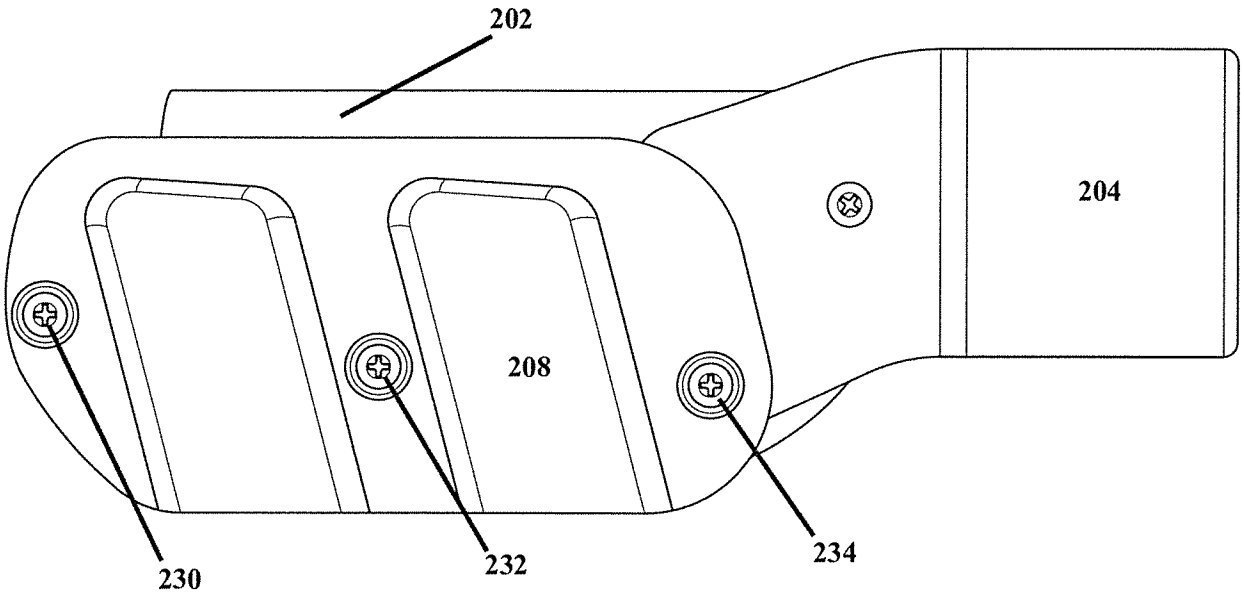
FIG. 4 is a backside view.
Figure 5:
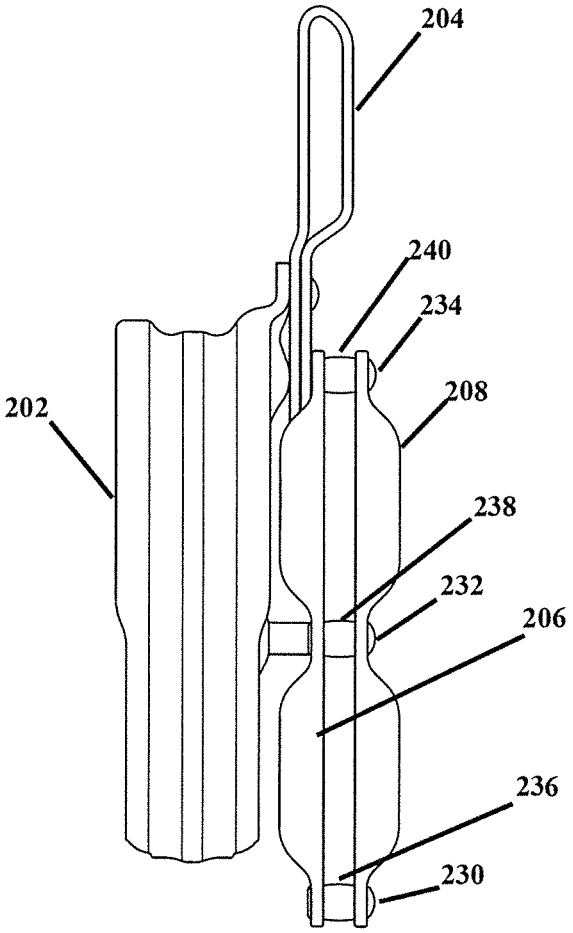
FIG. 5 is a front view.
Figure 6:
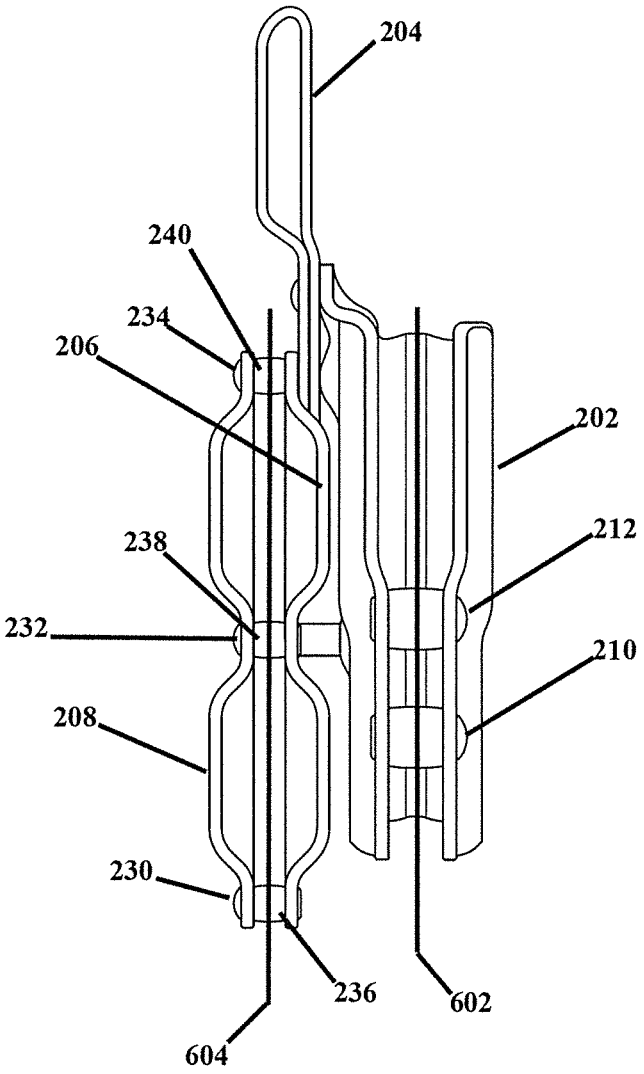
FIG. 6 is a rear view.
Figure 7:
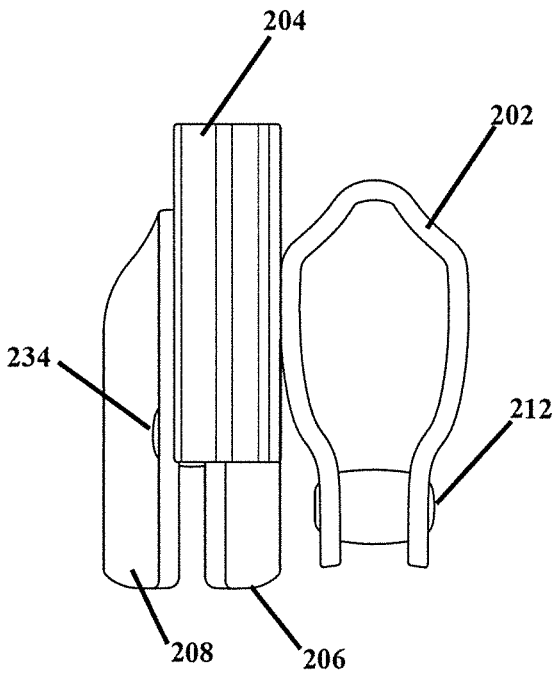
FIG. 7 is a top view.
Figure 8:
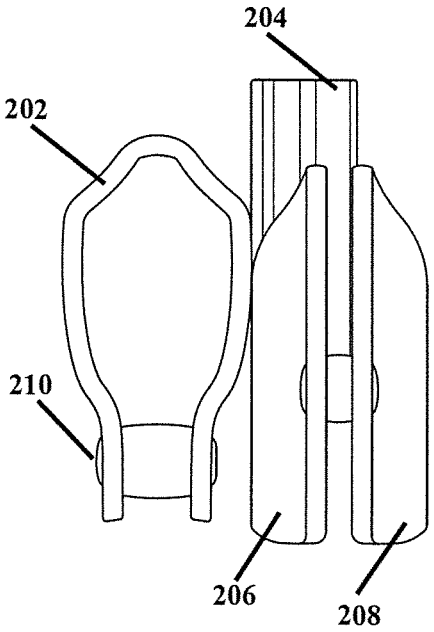
FIG. 8 is a bottom view.

The remaining figures show different views of the embodiment just described. FIG. 3 is a side view in an unloaded state looking toward a potential wearer. FIG. 4 is a backside view. FIG. 5 is a front view, FIG. 6 is a rear view, FIG. 7 is a top view and FIG. 8 is a bottom view. One thing to notice from these additional views is that, in the preferred embodiment, the plane of the spare magazines is offset though preferably parallel to the weapon in the holster. This is perhaps best seen in the rear view of FIG. 6, which shows the plane of the gun at 602 and the plane of the spare magazine(s) at 604. While the spare magazine(s) could be located immediately below the grip of the gun, offsetting them as shown eases construction and protects the spare magazines as being more proximate to the body of the wearer during use.

The invention claimed is:

1. A holster facilitating rapid magazine replacement for a pistol having a barrel and a magazine-receiving grip disposed at an angle relative to the barrel, the magazine having a magazine tube with a floor plate end, the holster comprising:

a pistol sleeve for receiving the barrel of the pistol;

a spare magazine holder configured for receiving the spare magazine such that the floor plate end is exposed for manipulation by a user; and wherein, when the holster is worn by a user:

the barrel of the pistol is received through an upwardly facing opening in the pistol sleeve, with the magazine-receiving grip of the pistol being oriented upwardly and rearwardly away from the pistol sleeve, and the spare magazine holder has a rearwardly facing opening below the magazine-receiving grip of the pistol of the pistol, such that a spare magazine in the spare magazine holder is supported at a predetermined angle corresponding to a magazine in the grip of the pistol in the pistol sleeve.

2. The holster of claim 1, wherein the predetermined angle is between zero to 15 degrees.

3. The holster of claim 1, wherein the spare magazine is parallel to the grip of the pistol in the pistol sleeve.

4. The holster of claim 1, wherein the spare magazine holder includes spaced-apart front and back panels defining each well.

5. The holster of claim 4, wherein one or both of the front and back panels are conformal to the magazine tube.

6. The holster of claim 1, wherein the spare magazine is frictionally disposed within the magazine holder.

7. The holster of claim 6, further including one or more fasteners for adjusting the spacing between the front and back panels to adjust the frictional engagement of the spare magazine disposed in the magazine holder.

8. The holster of claim 7, wherein the fasteners extend through compressible members between the front and back panels to maintain the adjusted spacing.

9. The holster of claim 1, wherein:

the barrel and the grip of the pistol define a plane; and wherein the spare magazine is disposed in the spare magazine holder in a plane parallel to the plane of the pistol.

10. The holster of claim 1, wherein:

the barrel and the grip of the pistol define a plane; and wherein the spare magazine is disposed in the spare magazine holder in a plane parallel and spaced apart from the plane of the pistol.

11. The holster of claim 1, wherein:

the barrel and the grip of the pistol define a plane; and wherein the spare magazine is disposed in the spare magazine holder in a plane spaced apart from the plane of the pistol toward a wearer of the holster.

12. The holster of claim 1, including a plurality of magazine holders in a vertical stack below the grip of a pistol in the pistol sleeve, each magazine holder being configured to receive a spare magazine at the same angle.

13. The holster of claim 12, including two magazine holders in a vertical stack below the grip of a pistol in the pistol sleeve, each magazine holder being configured to receive a spare magazine at the same angle.

* * * * *